US012708174B2

(12) United States Patent
Diard

(10) Patent No.: US 12,708,174 B2
(45) Date of Patent: Aug. 18, 2026

(54) FOOTWEAR INCLUDING MULTI-LEVEL SUPPORT MEMBER

(71) Applicant: DECKERS OUTDOOR CORPORATION, Goleta, CA (US)

(72) Inventor: Jean-Luc Diard, Annecy (FR)

(73) Assignee: DECKERS OUTDOOR CORPORATION, Goleta, CA (US)

( * ) Notice: Subject to any disclaimer, the term of this patent is extended or adjusted under 35 U.S.C. 154(b) by 0 days.

(21) Appl. No.: 18/605,815

(22) Filed: Mar. 14, 2024

(65) Prior Publication Data

US 2024/0306764 A1 Sep. 19, 2024

Related U.S. Application Data

(60) Provisional application No. 63/490,951, filed on Mar. 17, 2023.

(51) Int. Cl.

| | |
|---|---|
| ***A43B 13/02*** | (2022.01) |
| ***A43B 13/12*** | (2006.01) |
| ***A43B 13/14*** | (2006.01) |
| ***A43B 13/18*** | (2006.01) |
| ***A43B 13/22*** | (2006.01) |

(52) U.S. Cl.

CPC ..... *A43B 13/026* (2013.01); *A43B 13/125* (2013.01); *A43B 13/141* (2013.01); *A43B 13/143* (2013.01); *A43B 13/187* (2013.01); *A43B 13/223* (2013.01)

(58) Field of Classification Search

CPC ... A43B 13/026; A43B 13/125; A43B 13/141; A43B 13/143; A43B 13/187; A43B 13/223; A43B 13/181

See application file for complete search history.

(56) References Cited

U.S. PATENT DOCUMENTS

| | | | | |
|---|---|---|---|---|
| 6,389,713 | B1 * | 5/2002 | Kita | A43B 13/18 36/31 |
| 9,451,805 | B2 * | 9/2016 | Barnes | A43B 13/183 |
| 9,578,920 | B2 * | 2/2017 | Grott | A43B 7/1445 |
| 10,010,137 | B2 * | 7/2018 | Foxen | A43B 13/188 |
| 11,723,428 | B2 * | 8/2023 | Aubonnet | A43B 13/146 36/28 |
| 12,150,522 | B2 * | 11/2024 | Aubonnet | A43B 13/223 |
| 2002/0062578 | A1 | 5/2002 | Lussier et al. | |
| 2005/0108897 | A1 * | 5/2005 | Aveni | A43B 13/187 36/27 |
| 2007/0227040 | A1 | 10/2007 | Kilgore et al. | |
| 2011/0030245 | A1 | 2/2011 | Truelsen | |
| 2017/0035143 | A1 | 2/2017 | Sato et al. | |
| 2017/0325543 | A1 * | 11/2017 | Iuchi | A43B 13/186 |

(Continued)

OTHER PUBLICATIONS

PCT International Search Report and Written Opinion for corresponding PCT Patent Application No. PCT/US2024/020303 dated Jun. 12, 2024 (12 pages).

*Primary Examiner* — Bao-Thieu L Nguyen

(74) *Attorney, Agent, or Firm* — Greer, Burns & Crain, Ltd

(57) ABSTRACT

An article of footwear including an upper, a sole attached to the upper, and a support member on the sole, where the support member includes a body having a medial member and a lateral member and at least a part of one of the medial member and the lateral member are at a height that is different than a height of a part of the other of the medial member and the lateral member.

8 Claims, 13 Drawing Sheets

(56) References Cited

U.S. PATENT DOCUMENTS

| | | | | |
|---|---|---|---|---|
| 2021/0093040 | A1* | 4/2021 | Yoshida | A43B 13/187 |
| 2021/0161250 | A1 | 6/2021 | Conrad et al. | |
| 2022/0039506 | A1* | 2/2022 | Diard | A43B 13/143 |
| 2022/0142296 | A1 | 5/2022 | Head et al. | |
| 2022/0378147 | A1 | 12/2022 | Bruns et al. | |
| 2024/0057714 | A1* | 2/2024 | Kass | A43B 13/185 |
| 2024/0130462 | A1* | 4/2024 | Bidal | A43B 13/186 |

* cited by examiner

FOOTWEAR INCLUDING MULTI-LEVEL SUPPORT MEMBER

CROSS-REFERENCE TO RELATED APPLICATION

This application is a Non-provisional Application of and claims priority to U.S. Provisional Patent Application No. 63/490,951 filed on Mar. 17, 2023, the entire contents of which is incorporated herein by reference.

BACKGROUND

The present application relates generally to footwear, and more particularly, to a sole including a support member within the sole that supports a user's feet at multiple levels while providing resilient energy to the user's legs and feet to optimize energy efficiency and propel the user during use, such as during walking, jogging and running.

Movement, such as running, involves the transfer of energy between a person's legs and feet and an underlying surface, such as the ground, contributing to propelling a person forward along a trail, a sidewalk, a street or other path. The power a person is able to produce and the speed at which a person is able to move in a forward direction depends on a number of factors. For example, the ability to properly apply forces on a surface affects the energy produced and the rate of speed that the person is able to move. In particular, the propulsion generated by a person's legs and feet is important while walking, jogging or running. If a person's feet are not sufficiently supported by their shoes and their feet do not have a stable push off point, then less energy may be transferred from the person's feet to the ground to propel the person forward. Shoe constructions and the supportive systems in shoes are factors that help with proper force application and efficient energy transfer, which are useful factors while walking, jogging or running. A lack of support may also cause a person's legs to tire more quickly and thereby affect their ability to walk, jog or run longer distances.

There are many different types of structures for footwear to facilitate running efficiency and optimal force application. For example, some shoes include midsoles and outsoles that are made of materials having different characteristics such as different hardness values, density and elasticity, which provide more support in some areas and less support in other areas of a person's foot leading to different shock absorption and propulsion behaviors. For example, harder materials provide support to different areas of a user's feet by helping with proper force application and energy transfer during movement. In another example, a plate is inserted or embedded in the sole of a shoe to enhance the rigidity of the sole similar to harder materials. The plate is a supportive element that contributes to the performance attributes of a shoe while still allowing the other materials of the sole to provide cushioning in different areas of the foot, such as the heel, to provide comfort.

It is therefore desirable to provide footwear that supports a person's feet during walking, jogging and running while optimizing force application and energy transfer to enhance a person's walking, jogging and running efficiency.

SUMMARY

The present article of footwear includes a sole and a support member positioned on or within the sole that supports a user's feet at multiple levels or heights to provide different levels of support to a users' feet to promote a natural rolling motion of their feet while helping to reduce fatigue during movement, such as walking, jogging or running.

In an embodiment, an article of footwear is provided and includes an upper, a sole attached to the upper, and a support member on the sole, where the support member includes a body having a medial member and a lateral member and at least a part of one of the medial member and the lateral member are at a height that is different than a height of a part of the other of the medial member and the lateral member.

In another embodiment, a support member for an article of footwear is provided and includes a body having a medial member and a lateral member, where at least a part of one of said medial member and said lateral member being at a height that is different than a height of a part of said other of said medial member and said lateral member.

DETAILED DESCRIPTION

Figure 1:
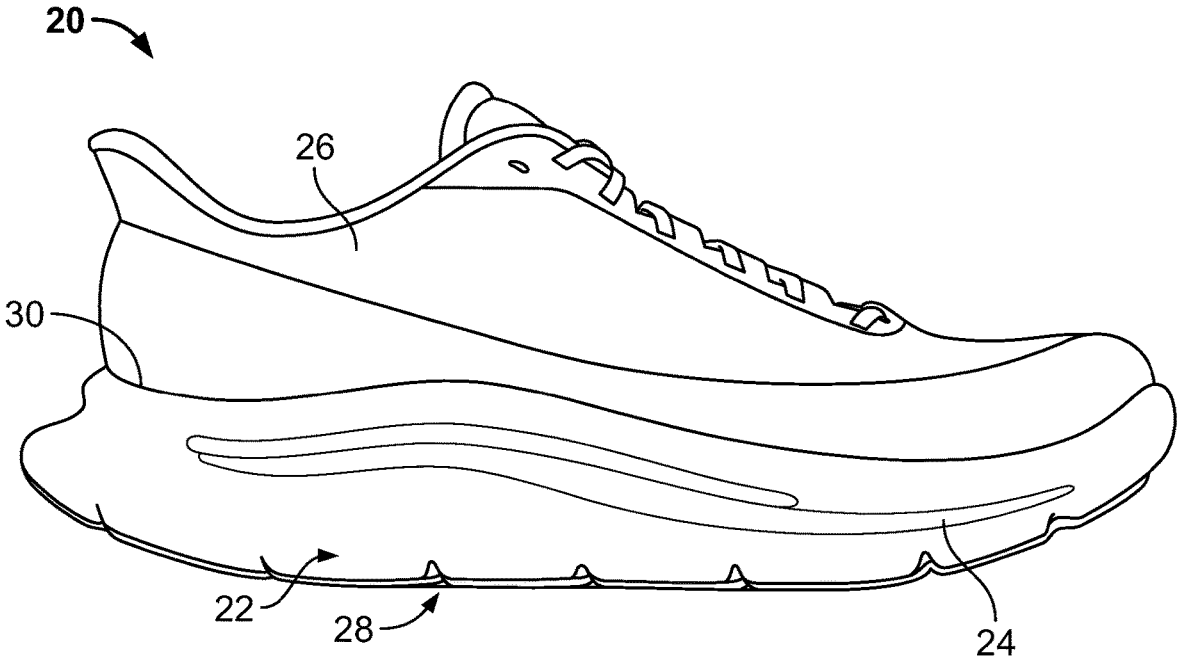
FIG. 1 is a right-side view of an embodiment of the present footwear.
Figure 2:
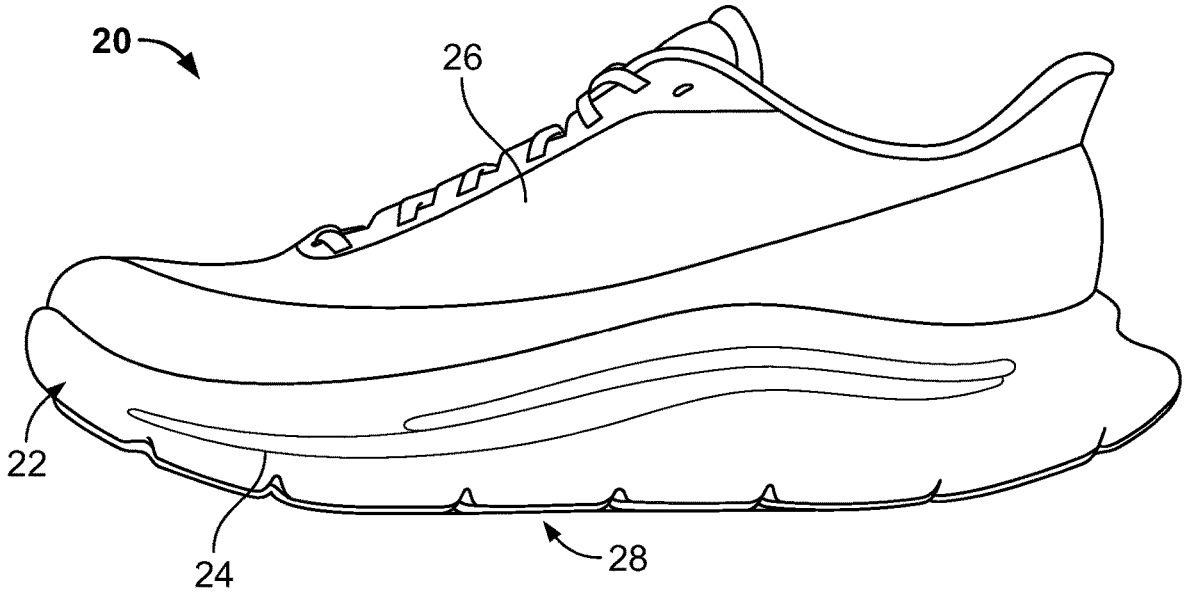
FIG. 2 is a left side view of the footwear of FIG. 1.
Figure 3:
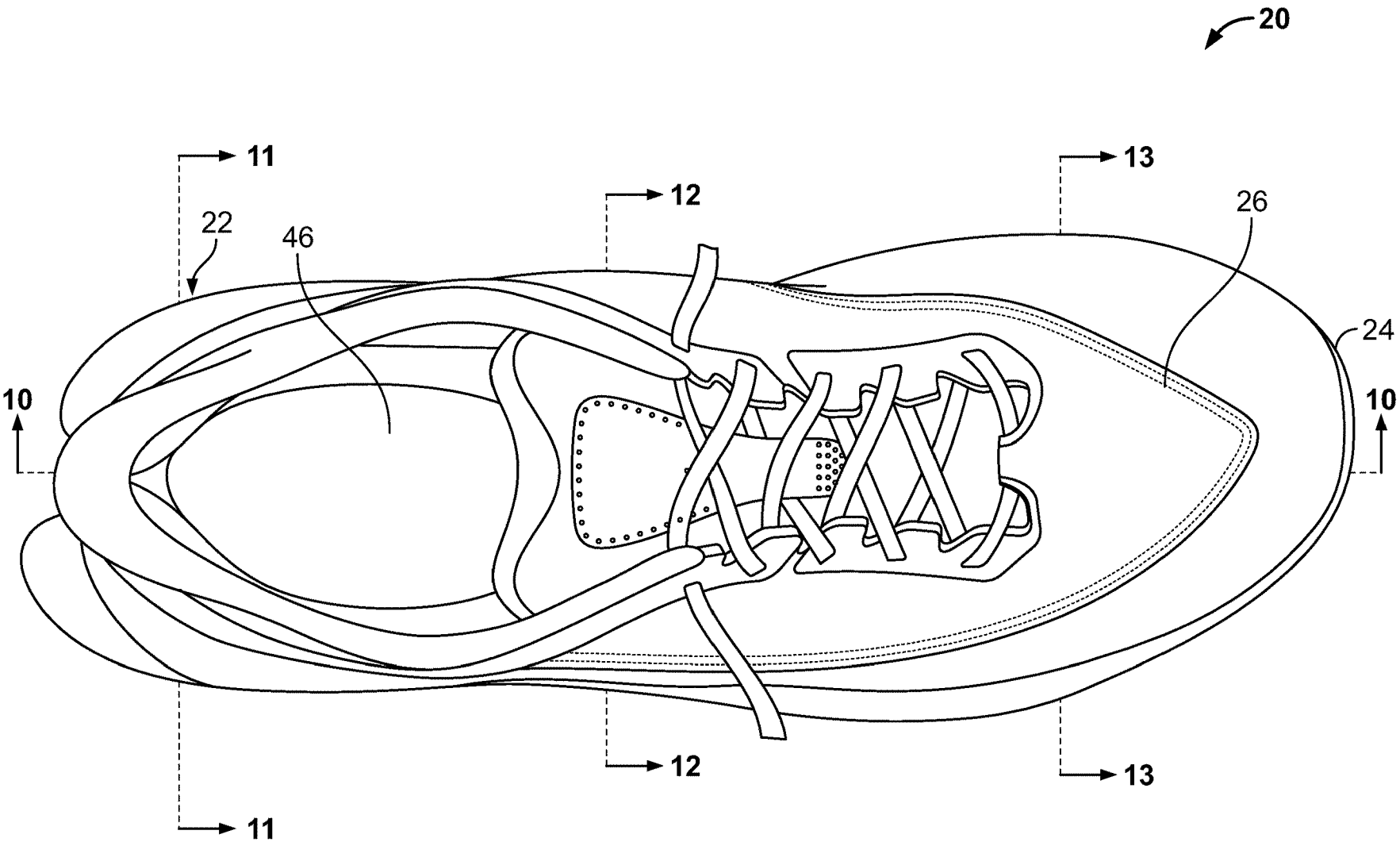
FIG. 3 is a top view of the footwear of FIG. 1.
Figure 4:
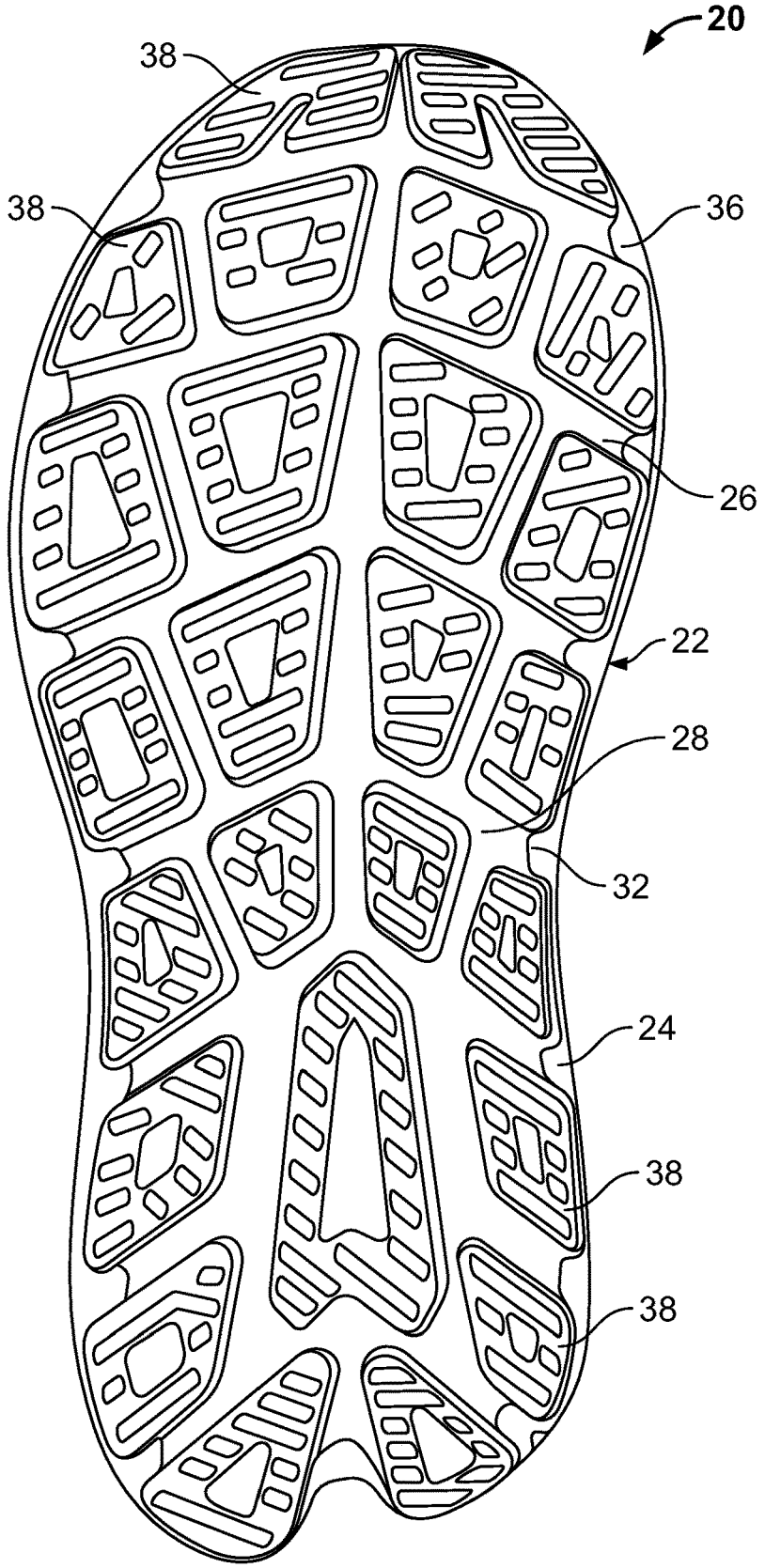
FIG. 4 is a bottom view of the footwear of FIG. 1.
Figure 5:
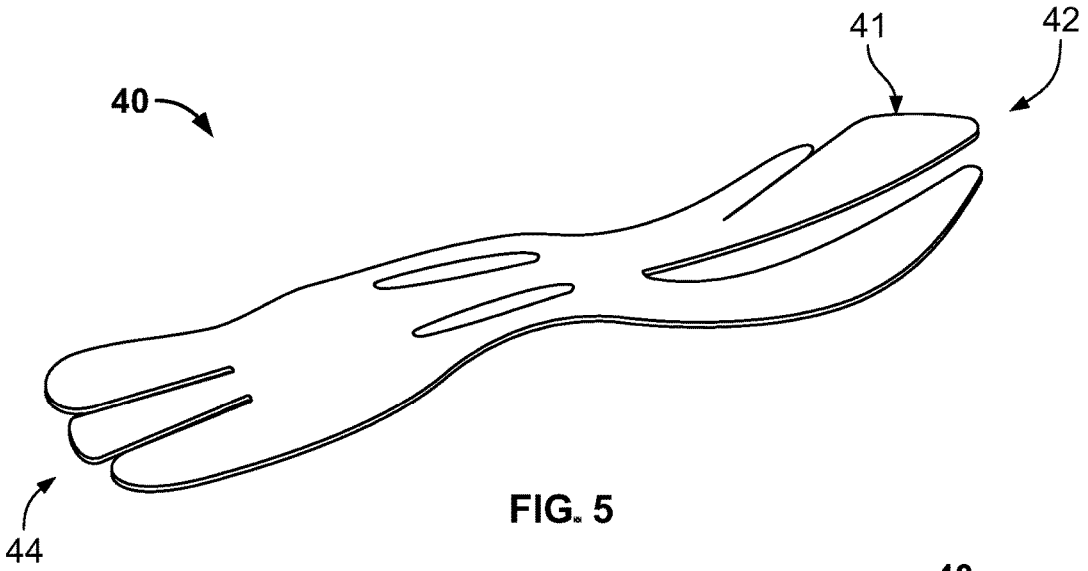
FIG. 5 is a perspective view of a multi-level support member placed in the footwear of FIG. 1.

The present footwear includes a sole and a multi-level support member that is on the sole, where the multi-level support member provides different amounts of support in different areas of a user's feet to enhance a natural rolling motion of the feet while providing stability and cushioning to the feet during movement.

Referring now to FIGS. 1-13, an article of footwear 20, such as a shoe, includes a sole, generally indicated as 22, where the sole 22 includes a midsole 24 attached to an upper 26, and an outsole 28 attached to the midsole. The midsole 24 is made of a substantially rigid material and has a peripheral wall 30 and a bottom wall 32 attached to the peripheral wall 30 that has an upper surface 34 and a bottom surface 36. The peripheral wall 30 and the bottom wall 32 may be integrally formed together to form the midsole 24 or formed separately and attached together in a compression molding process, by using an adhesive or by another suitable attachment process.

In the illustrated embodiment, the midsole 24 is made with ethylene-vinyl acetate (EVA), but may also be made with thermoplastic polyurethane (TPU), a foam material or any suitable material or combination of materials. As shown in FIGS. 1-4, the outsole 28 is attached to a bottom surface 36 of the midsole 24 by an adhesive or by molding, and is made of rubber. The outsole 28 typically includes a plurality of tread members 38 that are configured to grip an underlying surface, such as the ground, during movement. It should be appreciated that the outsole 28 may be made of any suitable material or combinations of materials.

Figure 6:
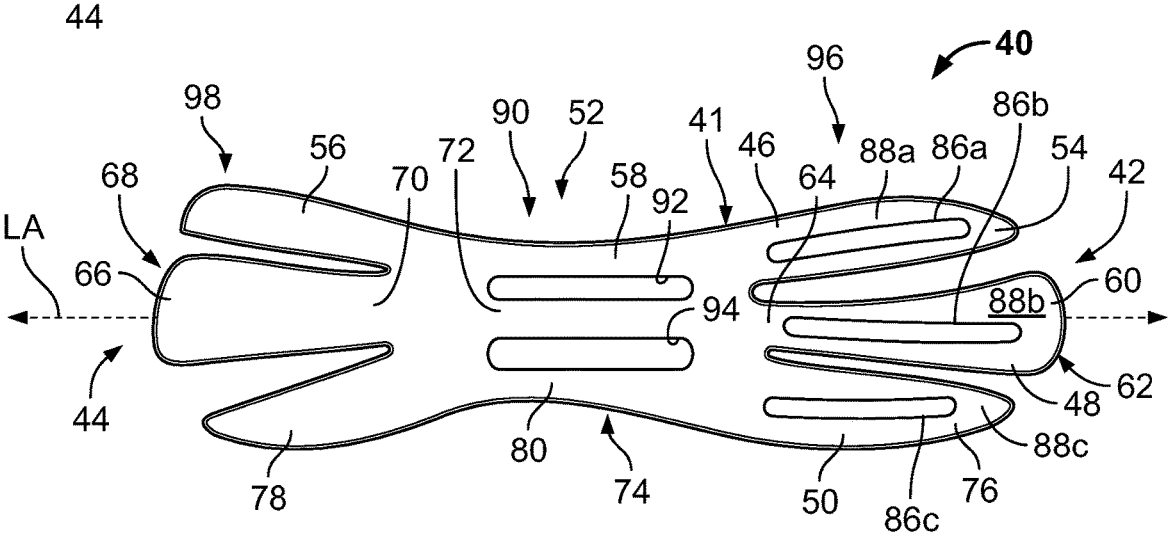
FIG. 6 is top view of the multi-level support member of FIG. 5.
Figure 7:
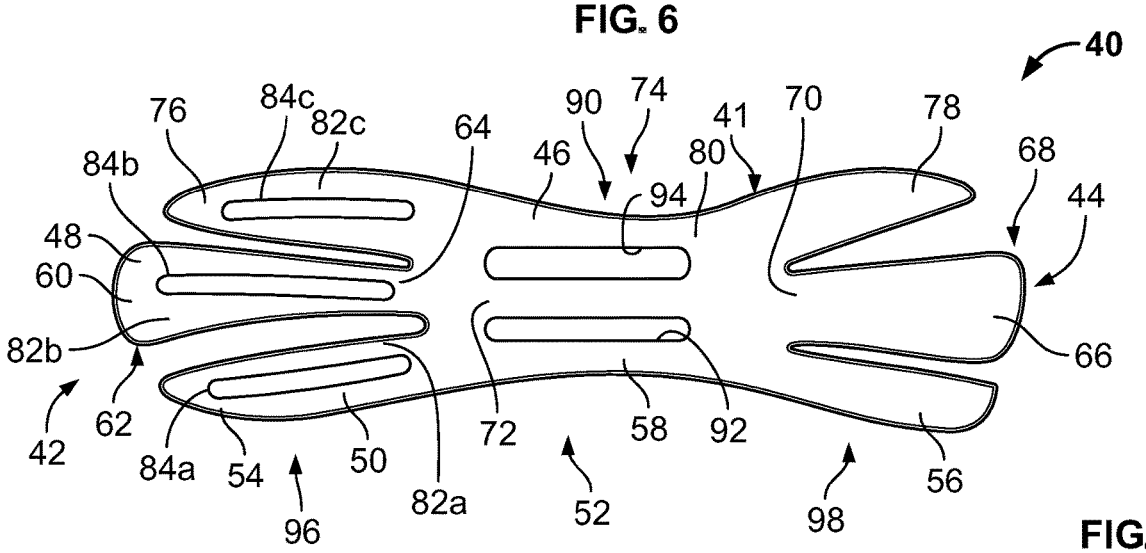
FIG. 7 is bottom view of the multi-level support member of FIG. 5.
Figure 8:
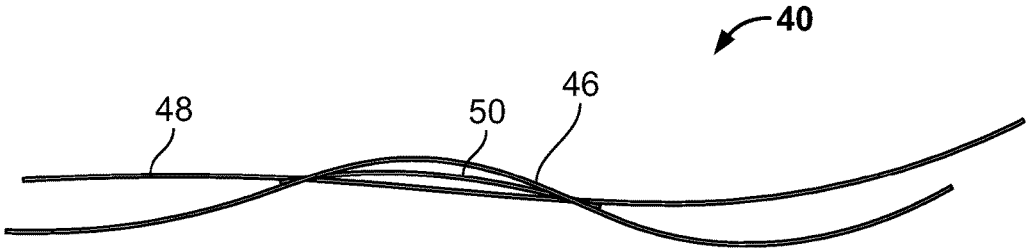
FIG. 8 is right side view of the multi-level support member of FIG. 5.
Figure 9:
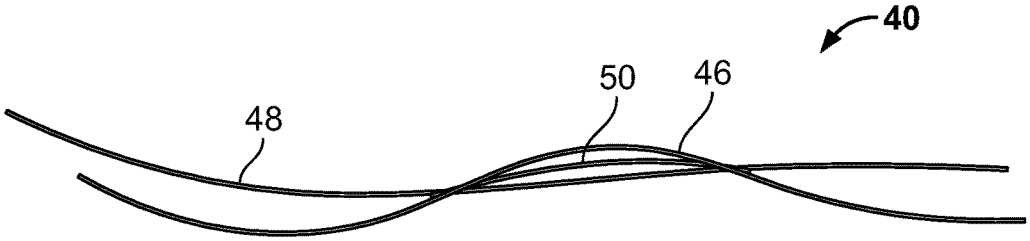
FIG. 9 is left side view of the multi-level support member of FIG. 5.
Figure 10:
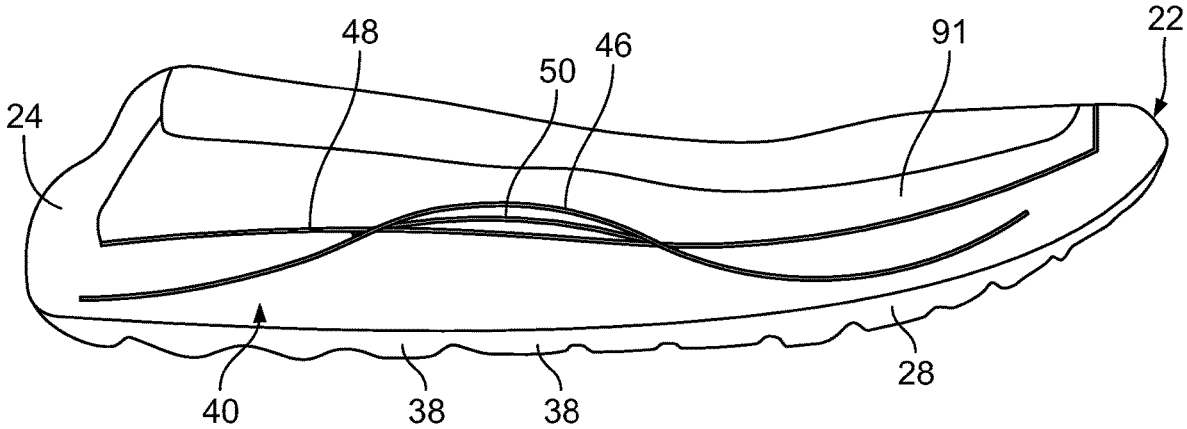
FIG. 10 is a cross-section view of the sole taken substantially along line 10-10 in FIG. 1 in the direction generally indicated.

Referring to FIGS. 5-10, a multi-level support member 40 is placed on the midsole or embedded in the midsole 24 as shown in FIG. 10. The multi-level support member 40 includes a body 41 having a front end 42 and a rear end 44 and a length defined by the distance between the front end and the rear end. As shown in FIGS. 6 and 7, the body 41 of the support member 40 includes a medial member 46, a central member 48 and a lateral member 50 that each extend between the front end 42 and the rear end 44. In the illustrated embodiment, the medial member 46, the central member 48 and the lateral member 50 are integrally formed together to form the body 41. In an embodiment, the body 41 is formed by a molding process, such a compression molding process or an injection molding process. In another embodiment, the medial member 46, the central member 48 and the lateral member 50 are made separately and then attached together by molding, welding, gluing or joined by any suitable manufacturing method.

The medial member 46 extends along the medial side 52 of the body 41 and has a front curved part 54 that curves upwardly (away from an underlying surface) toward the front end 42 of the body 41, and a rear curved part 56 that curves downwardly toward an underlying surface at the rear end 44 of the body 41. A middle curved part 58 extends between the front curved part 54 and the rear curved part 56 and has a convex shape, i.e., the curvature faces upwardly relative to an underlying surface.

The central member 48 has a front curved part 60 that is curved upwardly away from an underlying surface and has a first end 62 and a second end 64, where the first end 62 has a width that is greater than a width of the second end 64. As such, the front curved part 60 of the central member 48 gradually widens from the second end 64 to the first end 62. It should be appreciated that the second end 64 may have a width that is greater than a width of the first end 62 of the front curved part 60 or the front curved part 60 may have a uniform width along the length of the front curved part. The central member 48 also includes a rear part 66 that is substantially straight and extends at an angle relative to a longitudinal axis LA extending along the sole. In this embodiment, the rear part 66 forms an angle relative to a longitudinal axis LA of the body 41 that is 80° to 120°. It should be appreciated that the rear part 66 may form any suitable angle relative to the longitudinal axis LA of the body 41. Similar to the front curved part 60, the rear part 66 has a first end 68 with a width that is greater than a width of the second end 70. As such, the rear part 66 of the central member 48 gradually widens from the second end 70 to the first end 68. It should be appreciated that the second end 70 of the rear part 66 may have a width that is greater than a width of the first end 68 or the rear part 66 may have a uniform width along the length of the rear part. As shown, a middle part 72 extends between the front curved part 60 and the rear part 66 and is substantially flat. In other embodiments, the middle part 72 may have a convex curvature (curve that extends away from an underlying surface), a concave curvature (curve that extends toward an underlying surface) or a combination of a convex curvature and a concave curvature.

The lateral member 50 extends along the lateral side 74 of the body 41 and has a front curved part 76 that curves upwardly (away from an underlying surface) toward the front end 42 of the body 41, and a rear curved part 78 that curves downwardly toward an underlying surface at the rear end 44 of the body 41. A middle curved part 80 extends between the front curved part 76 and the rear curved part 78 and has a convex shape, i.e., the curvature faces upwardly relative to an underlying surface. As shown, the radius of curvature of the middle curved part 80 of the lateral member 50 is less than the radius of curvature of the middle curved part 58 of the medial member 46. In this way, the middle curved part 58 of the medial member 46 provides additional support in the instep or arch area of the foot on the medial side 52.

Additional rigidity may be added or formed in the body 41 to provide additional support in different areas of a foot during movement. In the illustrated embodiment of the support member 40, the bottom surfaces 82*a*, 82*b* and 82*c* of the front curved parts 54, 60 and 76 of the medial member 46, the central member 48 and the lateral member 50 each have a protruding member or ridge 84*a*, 84*b* and 84*c* that forms recessed areas 86*a*, 86*b* and 86*c* on the upper surfaces 88*a*, 88*b* and 88*c*. The ridges 84*a*, 84*b* and 84*c* on the bottom surfaces 82*a*, 82*b* and 82*c* of the medial member 46, the central member 48 and the lateral member 50 provide additional structural support to the portions of the medial member, the central member and the lateral member in which the ridges are formed. The ridges 84*a*, 84*b* and 84*c* may be formed in one, two or all of the medial, central and lateral members 46, 48 and 50. Further, the ridges 84*a*, 84*b* and 84*c* may have the same shape and length or different shapes and lengths depending the desired support for a user's feet and the ridges 84*a*, 84*b* and 84*c* may be formed on any portion of the body 41.

Additionally, a central portion 90 of the body 41 includes two elongated oval openings 92 and 94 that separate the medial member 46, the central member 48 and the lateral member 50 in this area. The openings 92 and 94 provide additional flexibility to the central portion 90 of the body 41 so that the central portion may flex or bend more than other portions of the body 41 such as the front portion 96 and rear portion 98 of the body 41. The body 41 may have one opening or a plurality of openings depending on the desired flexibility. Further, one or more openings may be formed in any portion of the body 41 and may be any suitable shape, width and length.

In the above embodiment, the support member 40 is preferably made with a carbon-fiber reinforced material but may also be made with metal, a composite material or any suitable combinations of materials. Also, the support member 40 may have any suitable length and width and preferably has a thickness of 1.0 mm to 1.5 mm. It should be appreciated that the thickness of the body 41 of the support member 40 may be the same or vary along the length of the body.

Figure 11:
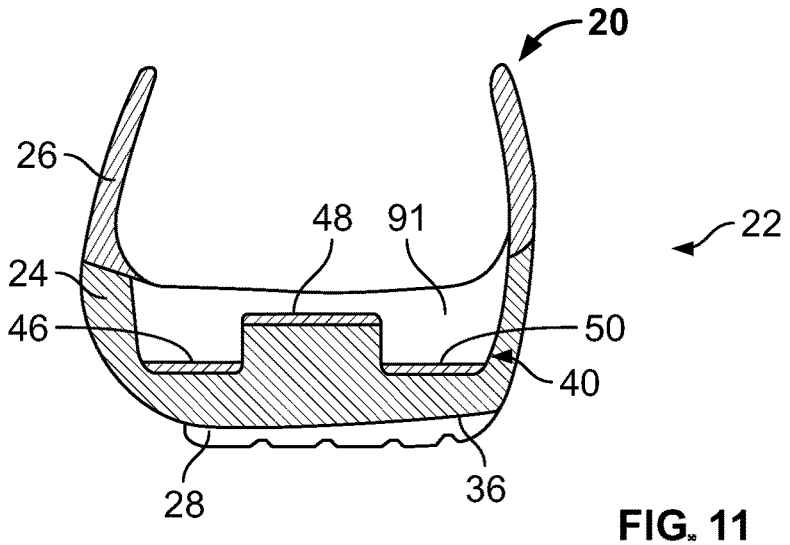
FIG. 11 is a cross-section view of the footwear of FIG. 1 taken substantially along line 11-11 in the direction generally indicated.
Figure 12:
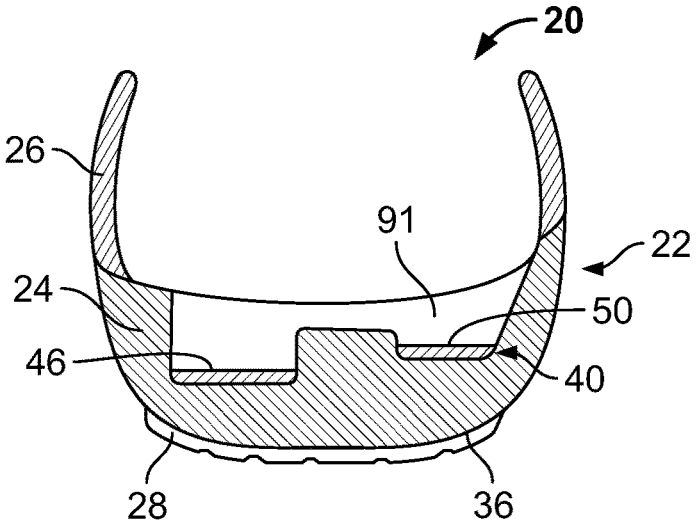
FIG. 12 is a cross-section view of the footwear of FIG. 1 taken substantially along line 12-12 in the direction generally indicated.
Figure 13:
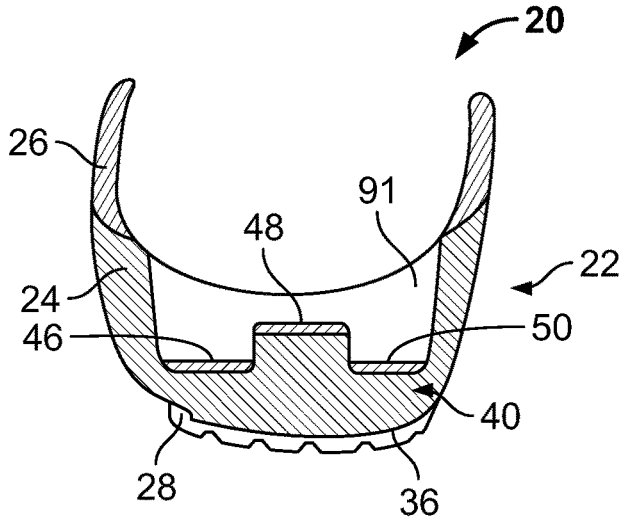
FIG. 13 is a cross-section view of the footwear of FIG. 1 taken substantially along line 13-13 in the direction generally indicated.

Referring to FIGS. 11 to 13, the heights (distance above an underlying surface or a percentage of the thickness of the midsole) of the front parts 54, 60, 76, middle parts 58, 72, 80 and rear parts 56, 66 and 78 of the medial member 46, the central member 48 and the lateral member 50 are different in different areas of the body 41 of the support member 40. In FIG. 11, the height of the rear part 66 of the central member 48 is greater than the heights of the rear parts 56 and 66 of the medial member 46 and the lateral member 50. Specifically, the heights of the rear parts 56 and 78 of the medial and lateral members 46 and 50 are each fifty percent (50%) of the thickness of the midsole 24 and the height of the rear part 66 of the central member 48 is seventy-five percent (75%) of the thickness of the midsole 24. It should be appreciated that the heights of the medial, central and lateral members 46, 48 and 50 may be the same or different. The configuration of the rear parts 56 and 78 of the medial, central and lateral members 46, 48 and 50 causes the rear part 66 of the central member 48 to compress the midsole 24 before the rear parts 56 and 78 of the medial and lateral members 46 and 50 compress the midsole thereby providing additional support in the central area of a heel of a foot during impact with the ground. Further, when all of the rear parts 56, 66 and 78 compress the midsole, the rear portion 98 of the support member 40 provides added propulsion to user's feet while the curvature of the rear parts 56 and 78 of the medial and lateral members 46 and 50 facilitate a rolling motion of the feet.

In the central portion 90 of the support member 40 shown in FIG. 12, the height (percentage of the midsole thickness) of the middle part 72 of the central member 48 is greater than the heights of the middle parts 58 and 80 of the medial and lateral members 46 and 50. Further, the height of the middle part 58 of the medial member 46 is greater than the height of the middle part 80 of the lateral member 50. This configuration provides additional support in the arch area of the foot, which enhances stability and helps to resist pronation of the foot during movement while also helping to reduce fatigue.

In the illustrated embodiment, a cushion member 91 or a plurality of cushion members are placed on the support member to provide cushioning and comfort to a user's feet. Each cushion member is preferably made with a foam material but may also be made with EVA or other suitable material or combination of materials. The thickness of the cushion member or cushion members depends on the desired level of cushioning in different areas of the sole. The combination of the cushion member and the support member determine the amount of support and cushioning for a user's feet.

Referring to FIG. 13, the heights of the front parts 54 and 76 of the medial and lateral members 46 and 50 are less than the height of the front part 60 of the central member 48. In the illustrated embodiment, the heights of the front parts 54 and 76 of the medial and lateral members 46 and 50 are twenty-five percent (25%) of the thickness of the midsole 24 and the height of the front part 60 of the central member 48 is fifty percent (50%) of the midsole thickness. It should be appreciated that the heights of the front parts 54, 60 and 76 of the medial, central and lateral members 46, 48 and 50 may be the same or different depending on the desired support at the front portion 96 of the support member 40. In this embodiment, the lower heights of the front parts 54 and 76 of the medial and lateral members 46 and 50 help to facility the natural rolling motion of a user's feet while the higher height of the front part 60 of the central member 48 gradually provides rigidity and stiffness during compression of the support member 40 to help improve the push off or pushing force of the front area of the user's feet on an underlying surface such as the ground.

Figure 14:
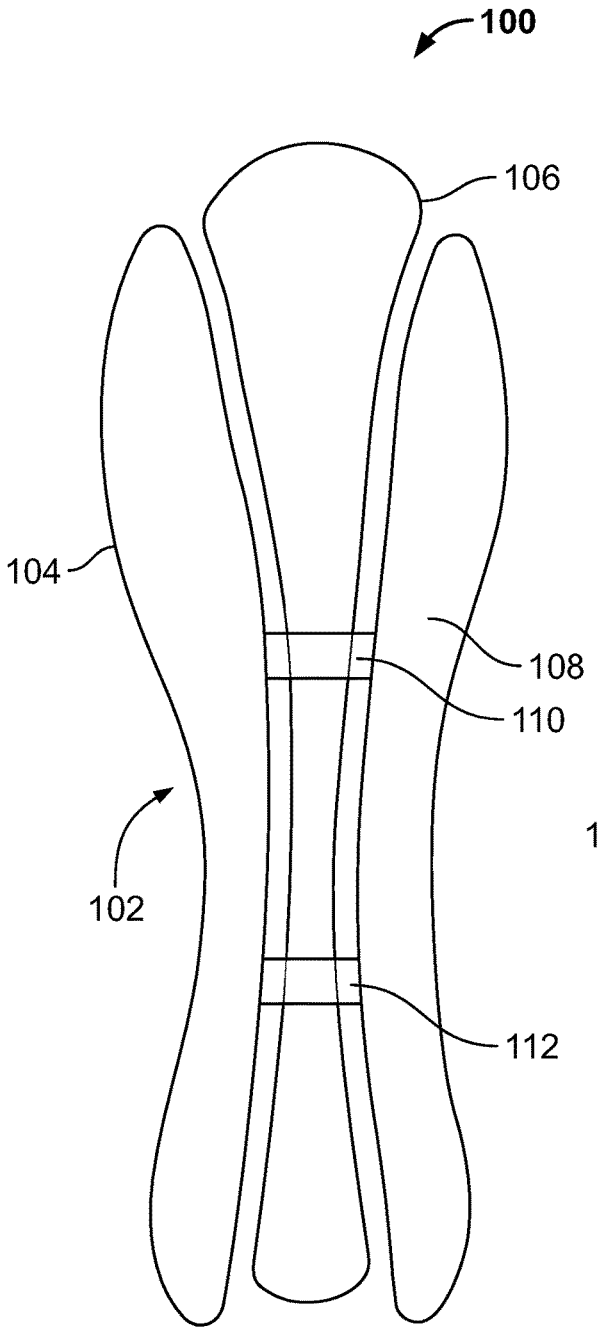
FIG. 14 is a top view of another embodiment of the multi-level support member.
Figure 15:
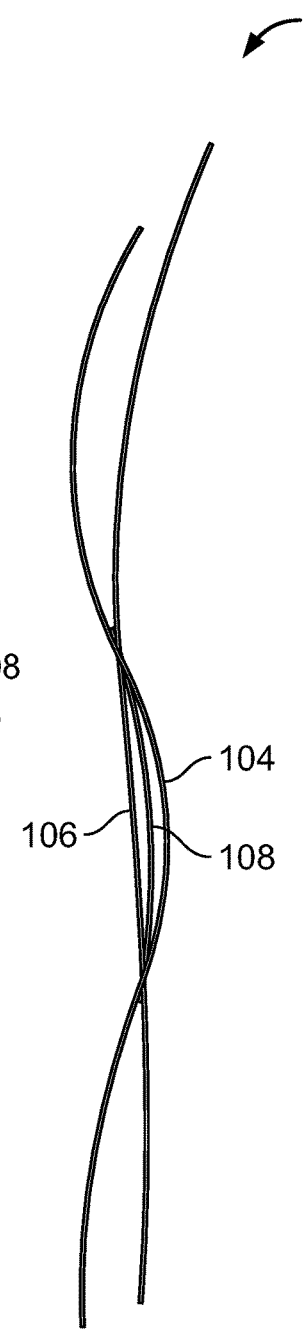
FIG. 15 is a left side view of the multi-level support member of FIG. 14.
Figure 16:
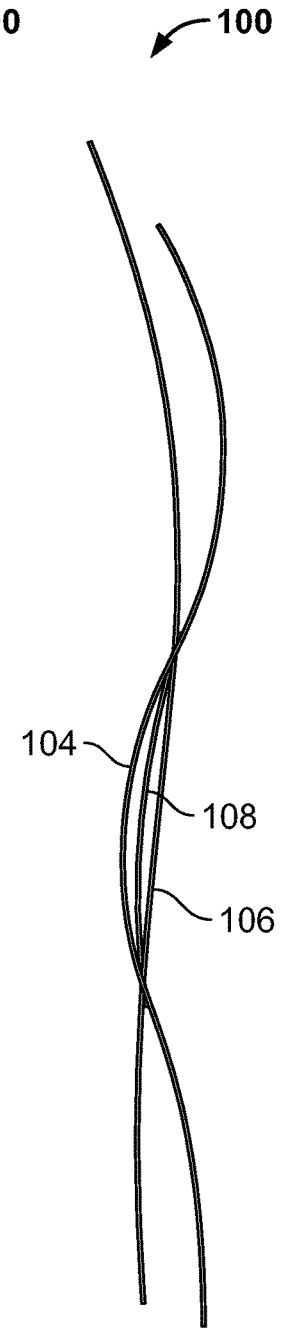
FIG. 16 is a right side view of the multi-level support member of FIG. 14.

Referring to FIGS. 14 to 16, another embodiment of the support member is shown where the support member 100 includes a body 102 having a medial member 104, a central member 106 and a lateral member 108 as described above. In this embodiment, the medial member 104, the central member 106 and the lateral member 108 are each independently made and then attached together by a first attachment member 110 and a second attachment member 112. As shown in FIG. 14, the first and second attachment members 110 and 112 each have a generally rectangular shape with a width and length, where the length is sufficient to extend across at least a portion of each of the medial, central and lateral members 104, 106 and 108. In the illustrated embodiment, the first attachment member 110 and the second attachment member 112 are spaced from each other where the first attachment member 110 is positioned at or adjacent to a forefoot area of a user's feet and the second attachment member 112 is positioned at or adjacent to a heel area of the user's feet. It should be appreciated that the first and second attachment members 110, 112 may have the same shape, width and length or different shapes, widths and lengths. Also, the first and second attachment members 110 and 112 may be positioned at any positions along the length of the support member 100. In the illustrated embodiment, the first and second attachment members 110 and 112 are attached to the medial, central and lateral members 104, 106 and 108 by molding but may also be attached to the medial, central and lateral members using an adhesive, by welding or using any suitable attachment method. As shown, the medial, central and lateral members 104, 106 and 108 are attached together so that there are spaces between each member. This allows the medial, central and lateral members 104, 106 and 108 to move, i.e., compress or flex, independently of each other, during movement.

Figure 17:
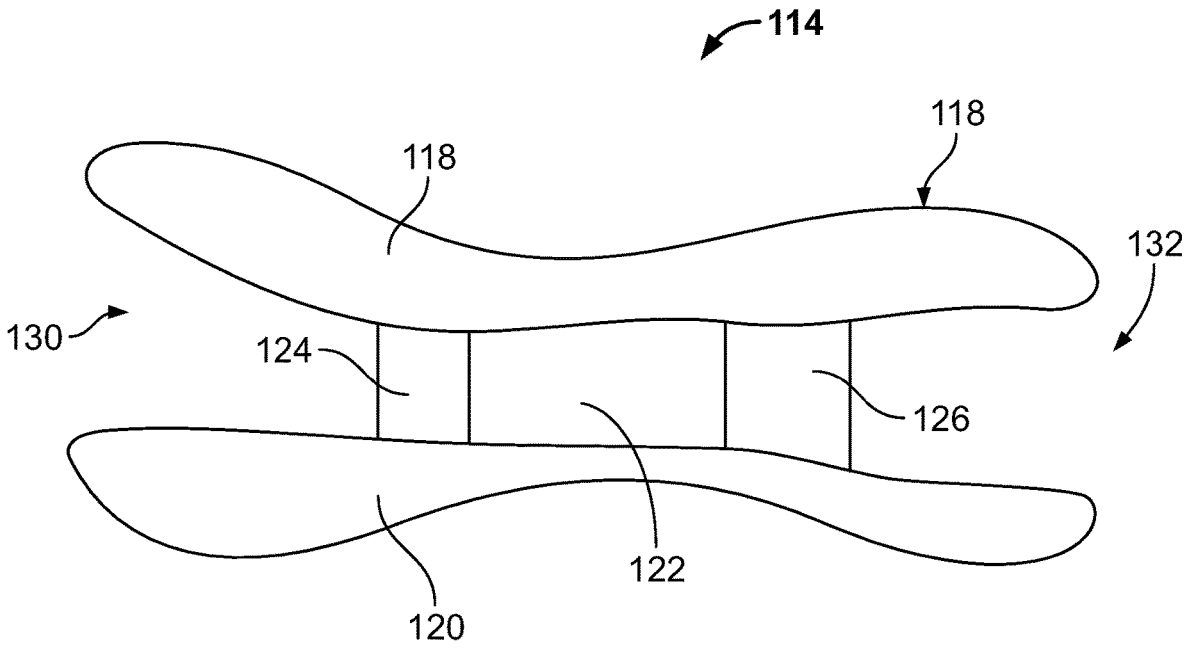
FIG. 17 is a top view of a further embodiment of the multi-level support member.

Referring to FIG. 17, another embodiment of the support member is shown where the support member 114 includes a body 116 having a medial member 118 and a lateral member 120 separated from each other to define a space 122. The medial member 118 and the lateral member 120 are attached to each other by a first attachment member 124 and a second attachment member 126 as described above. In this embodiment, the medial member 118 and the lateral member 120 each have lengths that are defined between the front end 130 and the second end 132 of the body 116. It should be appreciated that one or both of the medial and lateral support members 118 and 120 may be located in a certain portion of the sole, such as the heel area of the sole, and have the same shape, length and width or different shapes, lengths and widths. It should also be appreciated that the medial member 118 and the lateral member 120 may each have any suitable shape, length and width. In the illustrated embodiment, the support member 114 is designed to provide support along the medial side and the lateral side of the sole and have more cushioning along the middle portion of the sole.

Figure 18A:
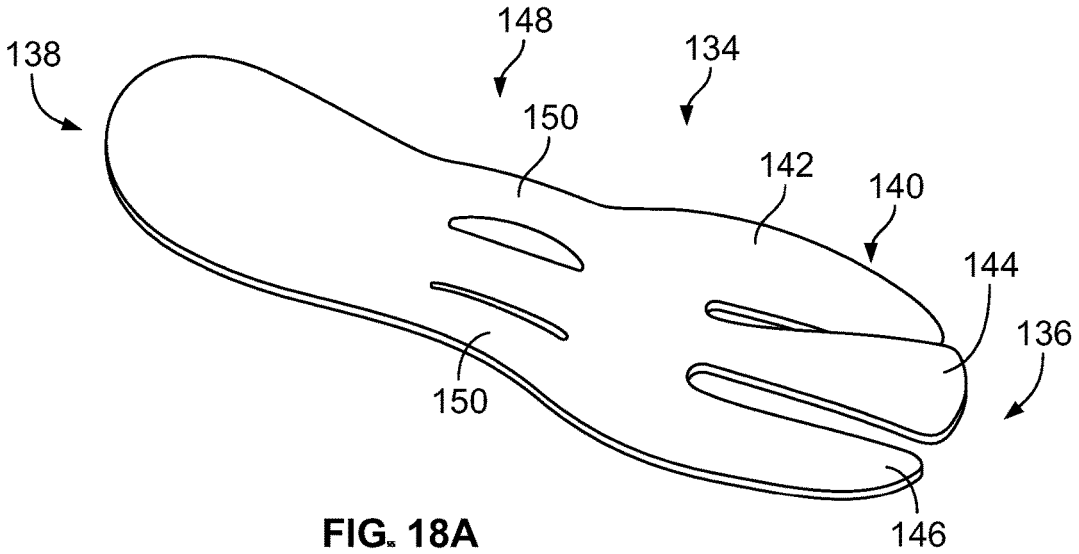
FIG. 18A is a perspective view of another embodiment of the support member.
Figure 18B:
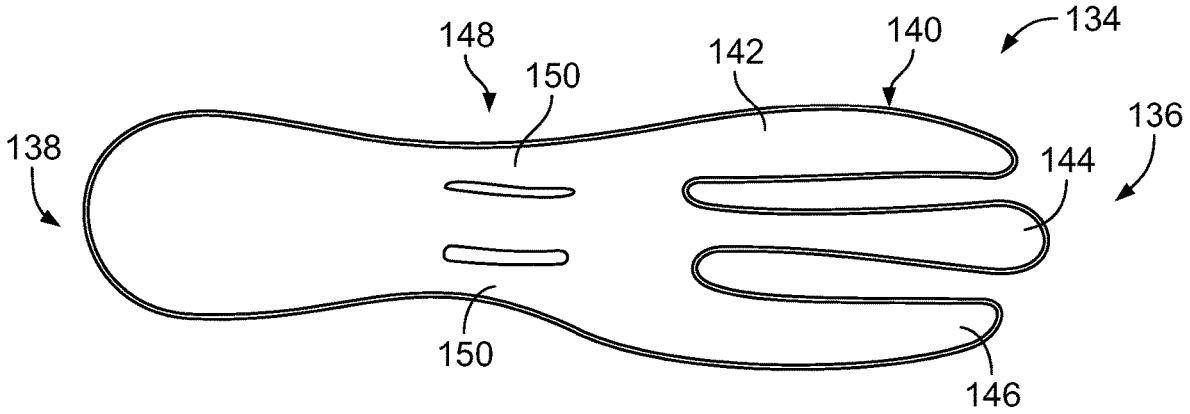
FIG. 18B is a top view of the support member of FIG. 18A.
Figure 18C:
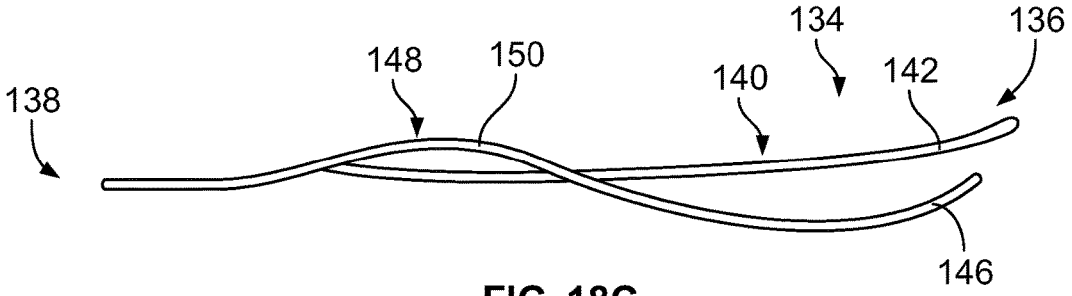
FIG. 18C is a side view of the support member of FIG. 18A.

Referring to FIGS. 18A to 18C, another embodiment of the support member is shown where the support member 134 has a front end 136 and a rear end 138 and extends from a forefoot area to a heel area of the sole. In this embodiment, the front end 136 has a multi-level portion 140 including a medial member 142, central member 144 and a lateral member 146, and the rear end 138 is substantially flat. In a middle area 148 between the front end 136 and the rear end 138, the medial and lateral members 142, 146 have a curved portion 150 with a convex shape (curve faces upward) and the central member 144 is substantially flat. The curved portion 150 of the medial and lateral members 142 and 146 provides support for the midfoot area of a user's foot. As shown, the medial member 142 and the lateral member 146 at the front end 136 of the support member 134 have the same shape and curvature and are located at a first height H1 above an underlying surface. The central member 144 also has a curvature and is located at a second height H2 relative to an underlying surface where the first height H1 and the second height H2 are different. As shown in FIG. 18C, the central member 144 is located above the medial and lateral members 142, 146 at the front end 136. It should be appreciated that the central member 144 may be located below the medial and lateral members 142, 146 or the medial member 142, the central member 144 and the lateral member 146 may all be located at different heights relative to an underlying support surface. It should also be appreciated that the rear end 138 and the middle area 148 may be substantially flat and the front end 136 has the multi-level portion 140 described above.

Figure 19A:
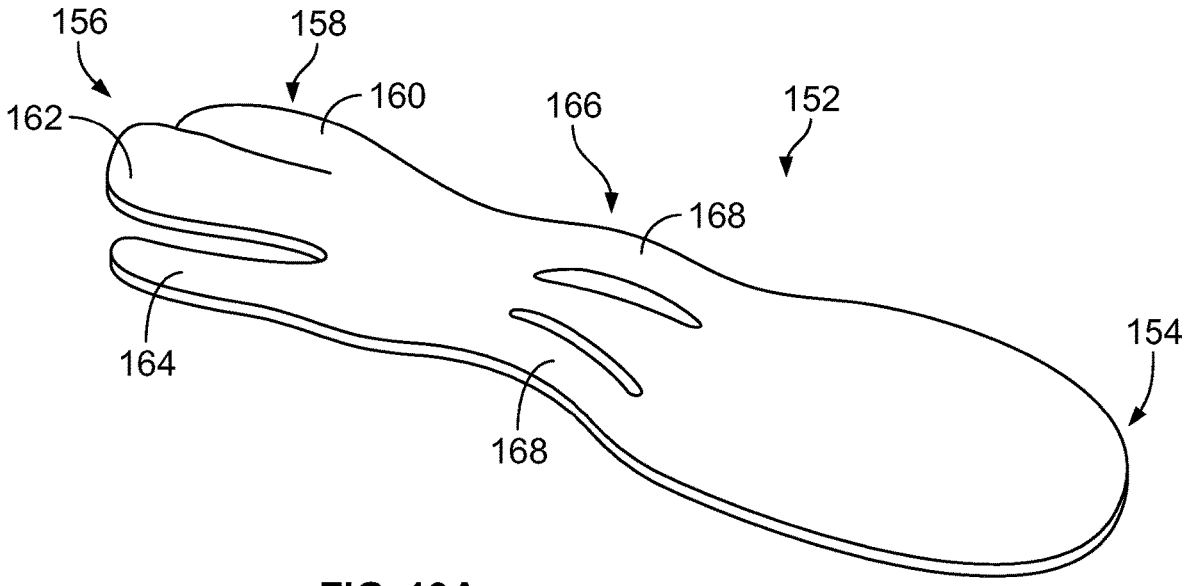
FIG. 19A is a perspective view of a further embodiment of the support member.
Figure 19B:
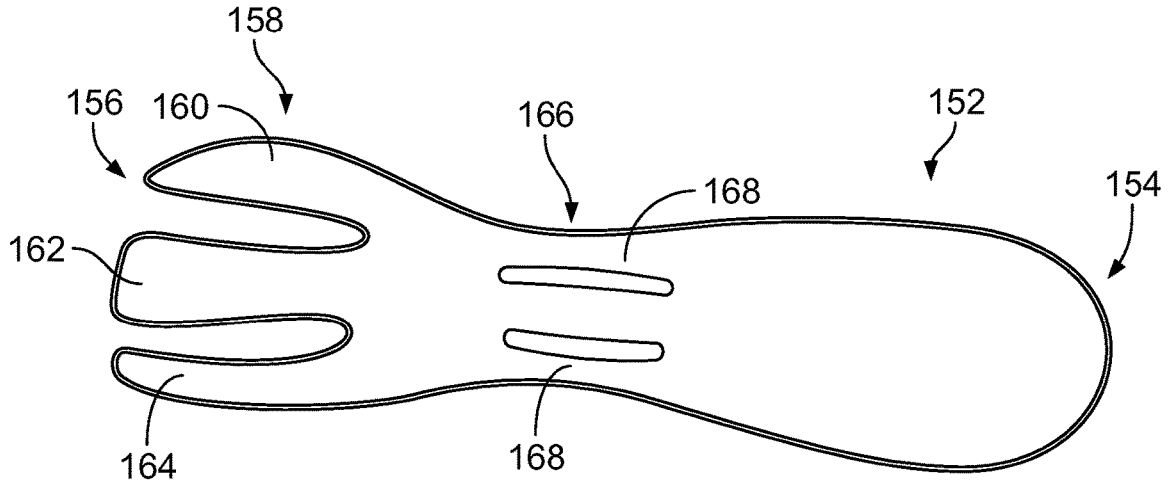
FIG. 19B is a top view of the support member of FIG. 19A.
Figure 19C:
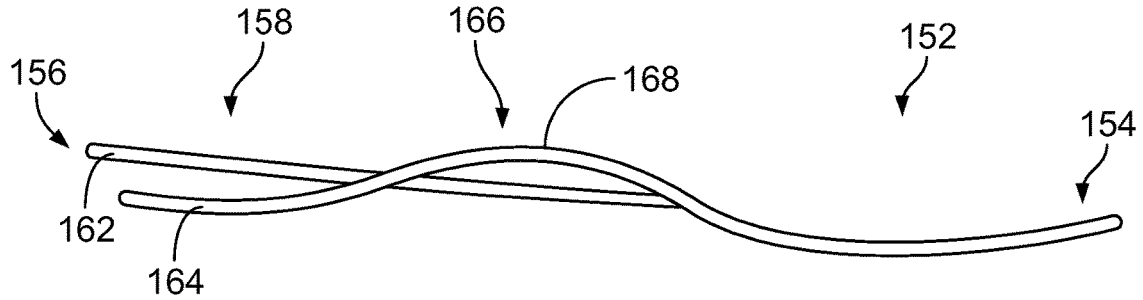
FIG. 19C is a side view of the support member of FIG. 19A.

Referring to FIGS. 19A to 19C, a further embodiment of the support member is shown where the support member 152 has a front end 154 and a rear end 156 and extends from a forefoot area to a heel area of the sole. In this embodiment, the rear end 156 has a multi-level portion 158 including a medial member 160, a central member 162 and a lateral member 164, and the rear end 156 is substantially flat. In a middle area 166 between the front end 154 and the rear end 156, the medial and lateral members 160, 164 have a curved portion 168 with a convex shape (curve faces upward) and the central member 162 is substantially flat. The curved portion 168 of the medial and lateral members 160, 164 provides support for the midfoot area of a user's foot. As shown, the medial member 160 and the lateral member 164 at the rear end 156 of the support member 152 have the same shape and curvature and are located at a first height H1 above an underlying surface. The central member 162 also has a curvature and is located at a second height H2 relative to an underlying surface where the first height H1 and the second height H2 are different. As shown in FIG. 19C, the central member 162 is located above the medial and lateral members 160, 164 at the rear end 156. It should be appreciated that the central member 162 may be located below the medial and lateral members 160, 164 or the medial member 160, the central member 162 and the lateral member 164 may all be located at different heights relative to an underlying support surface. It should also be appreciated that the front end 154 and the middle area 166 may be substantially flat and the rear end 156 has the multi-level portion described above.

Figure 20:
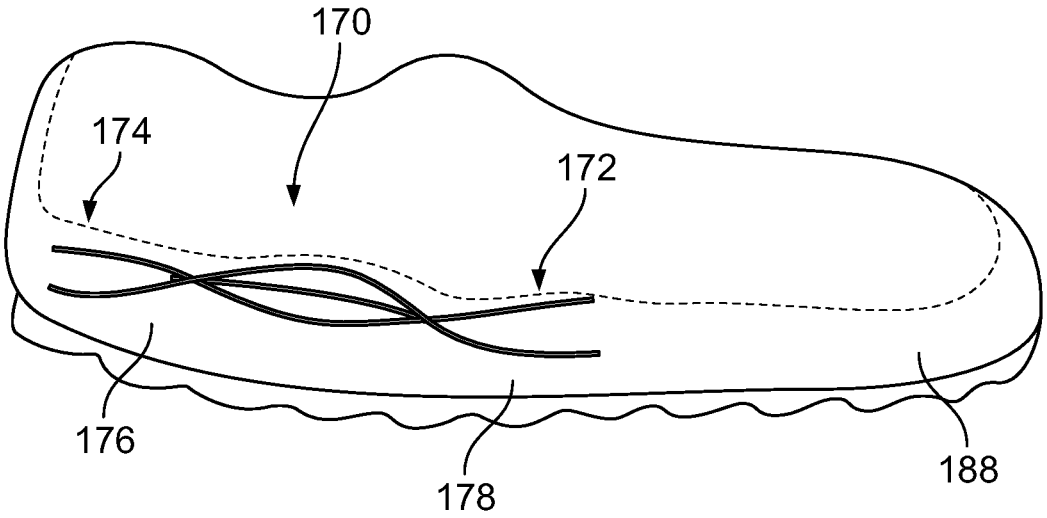
FIG. 20 is a fragmentary side view of the article of footwear showing an embodiment of the support member.
Figure 21:
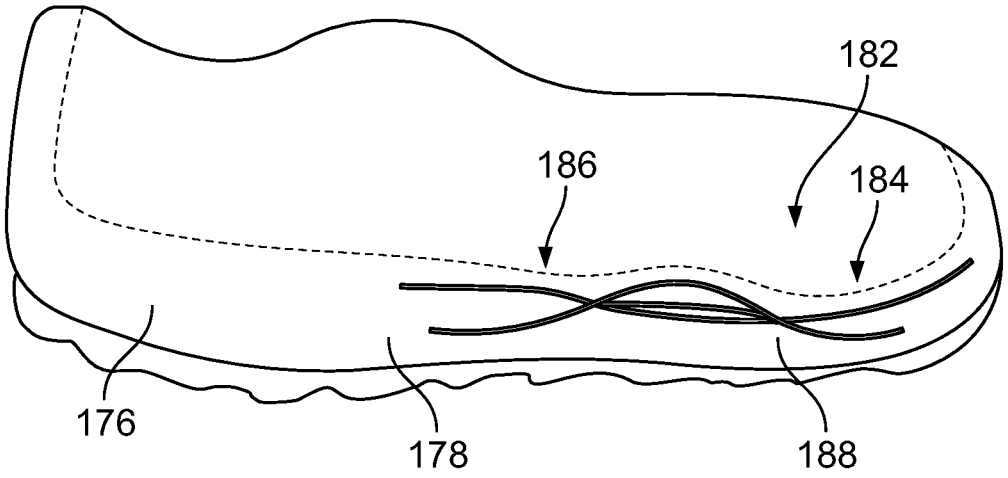
FIG. 21 is a fragmentary side view of the article of footwear showing another embodiment of the support member.
Figure 22:
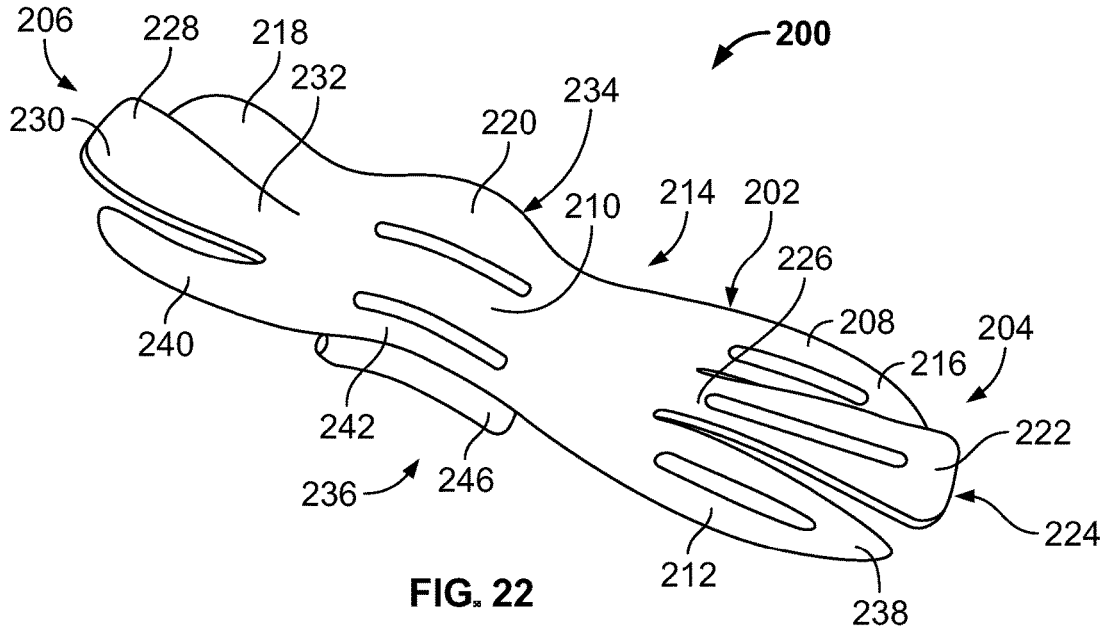
FIG. 22 is a perspective view of another embodiment of the support member.

Referring to FIGS. 20 and 21, another embodiment of the support member is shown where the support member has the configuration described above in FIGS. 5-10 and the length of the support member is less than the length of the sole. In FIG. 20, the support member 170 has a front end 172 and a rear end 174 that define a length where the support member extends from the heel area 176 to the midfoot area 178 of the sole 180. In this embodiment, the support member 170 provides support to a rear portion of a user's foot. In FIG. 21, the support member 182 has a front end 184 and a rear end 186 that define a length where the support member 182 extends from the midfoot area 178 to the forefoot area 188 of the sole 180. In this embodiment, the support member 182 provides support to the front area of a user's foot. It should be appreciated that the support member may be any suitable length and may be located in any portion of the sole.

Figure 23:
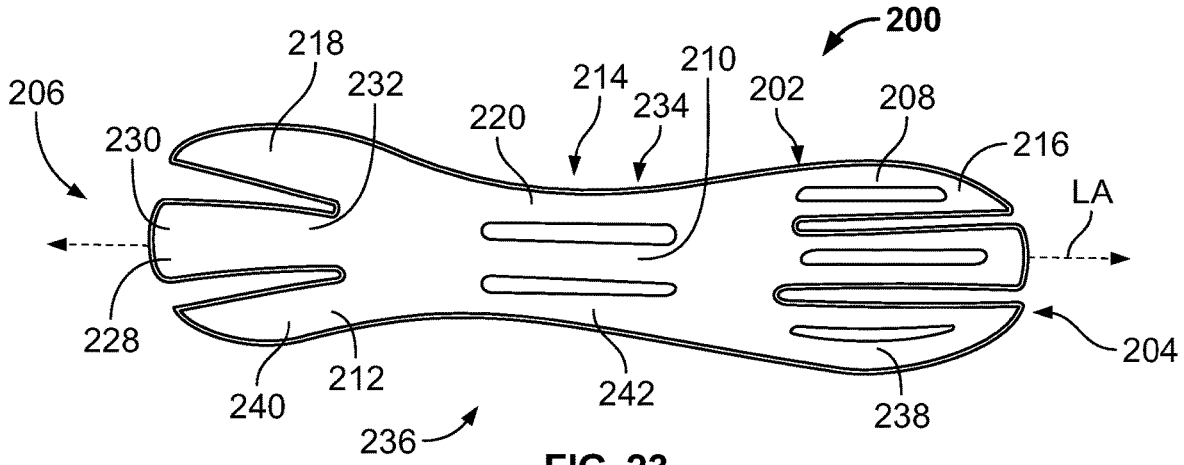
FIG. 23 is a top view of the support member of FIG. 22.
Figure 24:
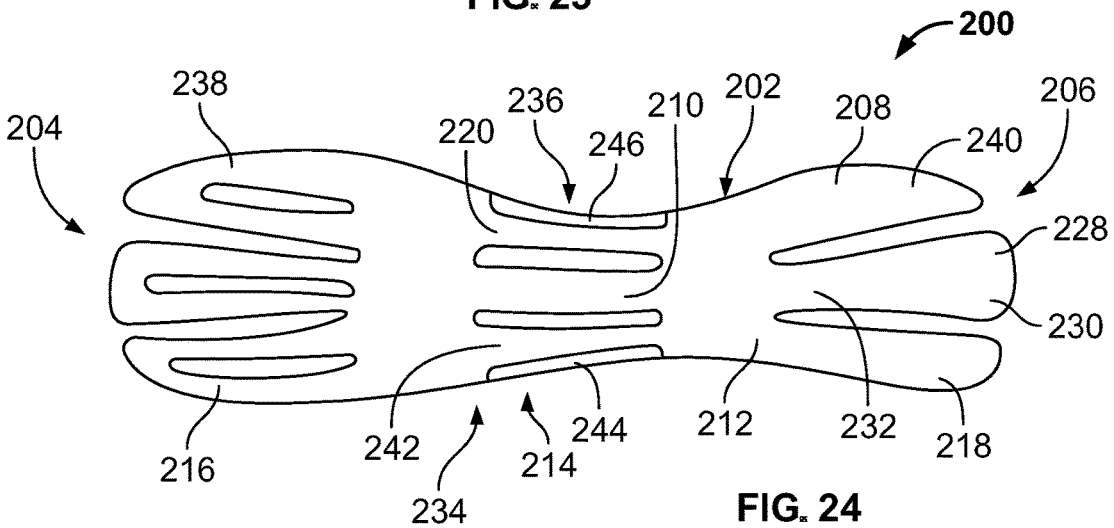
FIG. 24 is a bottom view of the support member of FIG. 22.
Figure 25:
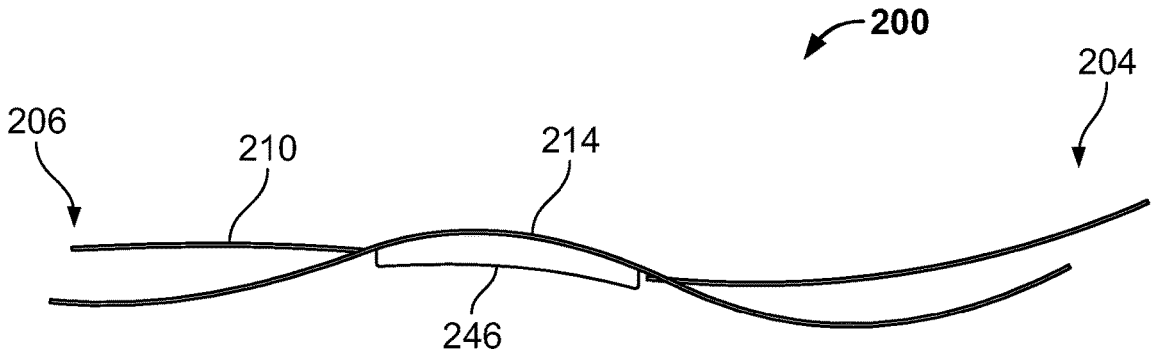
FIG. 25 is a right side view of the support member of FIG. 22.
Figure 26:
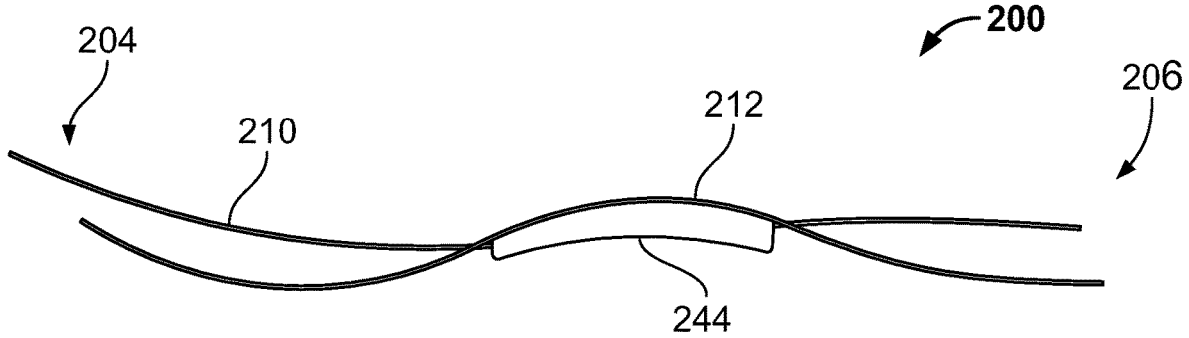
FIG. 26 is a left side view of the support member of FIG. 22.

Referring now to FIGS. 22 to 26, another embodiment of the multi-level support member is shown and generally indicated as 200, where the support member 200 is positioned on or embedded at least partially in the midsole as described above. The multi-level support member 200 includes a body 202 having a front end 204 and a rear end 206 and a length defined by the distance between the front end and the rear end. As shown in FIGS. 23 and 24, the body 202 of the support member 200 includes a medial member 208, a central member 210 and a lateral member 212 that each extend between the front end 204 and the rear end 206. In the illustrated embodiment, the medial member 208, the central member 210 and the lateral member 212 are integrally formed together to form the body 202. In an embodiment, the body 202 is formed by a molding process, such a compression molding process or an injection molding process. In another embodiment, the medial member 208, the central member 210 and the lateral member 212 are made separately and then attached together by molding, welding, gluing or joined by any suitable manufacturing method.

The medial member 208 extends along the medial side 214 of the body 202 and has a front curved part 216 that curves upwardly (away from an underlying surface) toward the front end 204 of the body 202, and a rear curved part 218 that curves downwardly toward an underlying surface at the rear end 206 of the body 202. A middle curved part 220 extends between the front curved part 216 and the rear curved part 218 and has a convex shape, i.e., the curvature faces upwardly relative to an underlying surface.

The central member 210 has a front curved part 222 that is curved upwardly away from an underlying surface and has a first end 224 and a second end 226, where the first end 224 has a width that is greater than a width of the second end 226. As such, the front curved part 222 of the central member 210 gradually widens from the second end 226 to the first end 224. It should be appreciated that the second end 226 may have a width that is greater than a width of the first end 224 of the front curved part 222 or the front curved part 222 may have a uniform width along the length of the front curved part. The central member 210 also includes a rear part 228 that is substantially straight and extends at an angle relative to a longitudinal axis extending along the sole. In this embodiment, the rear part 228 forms an angle relative to a longitudinal axis LA of the body 202. It should be appreciated that the rear part 228 may form any suitable angle relative to the longitudinal axis LA of the body 202. Similar to the front curved part 222, the rear part 228 has a first end 230 with a width that is greater than a width of the second end 232. As such, the rear part 228 of the central member 210 gradually widens from the second end 232 to the first end 230. It should be appreciated that the second end 232 of the rear part 228 may have a width that is greater than a width of the first end 230 or the rear part 228 may have a uniform width along the length of the rear part. As shown, a middle part 234 extends between the front curved part 232 and the rear part 228 and is substantially flat. In other embodiments, the middle part 234 may have a convex curvature (curve that extends away from an underlying surface), a concave curvature (curve that extends toward an underlying surface) or a combination of a convex curvature and a concave curvature.

The lateral member 212 extends along the lateral side 236 of the body 202 and has a front curved part 238 that curves upwardly (away from an underlying surface) toward the front end 204 of the body 202, and a rear curved part 240 that curves downwardly toward an underlying surface at the rear end 206 of the body 202. A middle curved part 242 extends between the front curved part 238 and the rear curved part 240 and has a convex shape, i.e., the curvature faces upwardly relative to an underlying surface. As shown, the radius of curvature of the middle curved part 242 of the lateral member 212 is less than the radius of curvature of the middle curved part 242 of the medial member 208. In this way, the middle curved part 242 of the medial member 208 provides additional support in the instep or arch area of the foot on the medial side 214.

In this embodiment, the body 202 of the support member 200 includes at least one medial side support 244 and at least one lateral side support 246 that each extend downwardly from the body 202 on the medial side 214 and the lateral side 212 of the body 202. In the illustrated embodiment, the medial side support 244 and the lateral side support 246 are located at the middle of the body 202 but it should be appreciated that the medial side support 244 and the lateral side support 246 may be located at an location along the medial and lateral sides of the body 202. It should also be appreciated that the medial side support 244 and the lateral side support 246 may be at the same location on the medial and lateral sides of the body 202 or at different locations on the body. Furthermore, the length, width, height and shape of the medial side support 244 and the lateral side support 246 may be the same or different. The medial side support 244 and the lateral side support 246 extend along a surface of the midsole and helps to limit lateral movement of the support member 200 on the sole and provide additional rigidity to the medial and lateral sides of the body 202. In another embodiment, the body 202 of the support member 200 includes only one of the medial side support 244 or the lateral side support 246. In a further embodiment, at least one of the medial side support 244 and the lateral side support 246 extends upwardly from the body 202 along the surface of the midsole. It should be appreciated that the medial and lateral side supports 244, 246 may both extend upwardly or downwardly from the body 202 or may extend in different directions from the body. In an embodiment, at least a portion of at least one of the medial side support 244 and the lateral side support 246 are exposed on visible on an outer surface of the sole.

In the above embodiment, the support member 200 is preferably made with a carbon-fiber reinforced material but may also be made with metal, a composite material or any suitable combinations of materials. Also, the support member 40 may have any suitable length and width and preferably has a thickness of 1.0 mm to 1.5 mm. It should be appreciated that the thickness of the body 202 of the support member 200 may be the same or vary along the length of the body.

While particular embodiments of the present footwear and associated support member are shown and described, it will be appreciated by those skilled in the art that changes and modifications may be made thereto without departing from the invention in its broader aspects and as set forth in the following claims.

What is claimed is:

1. An article of footwear comprising:

an upper;

a sole attached to said upper; and a support member on said sole, said support member including body having a front end and an opposing rear end, said support member further including a medial member, a central member and a lateral member, wherein said medial member, said central member and said lateral member have free unattached ends at said front end of said body and free unattached ends at said rear end of said body, wherein said free unattached ends at said front end of said body and at said rear end of said body are separated from each other, wherein a height above an underlying surface of said central member at said front end of said body is different than heights above said underlying surface of said medial member and said lateral member at said front end of said body, and wherein a height above said underlying surface of said central member at said rear end of said body is different than heights above said underlying surface of said medial member and said lateral member at said rear end of said body.

2. The article of footwear of claim 1, wherein said middle part of each of said medial member and said lateral member has a radius of curvature, said radius of curvature of said middle part of said medial member being greater than a radius of curvature of said middle part of said lateral member.

3. The article of footwear of claim 1, further comprising a cushion member on at least a portion of said support member.

4. The article of footwear of claim 1, wherein said body includes at least one opening.

5. The article of footwear of claim 1, wherein said body includes a plurality of openings, said openings being spaced from each other.

6. The article of footwear of claim 1, wherein said medial member and said lateral member each include a protruding member to provide additional rigidity to said medial member and said lateral member.

7. The article of footwear of claim 1, further comprising a first attachment member and a second attachment member, said first and second attachment members being attached to said medial member and said lateral member to connect said medial member and said lateral member together.

8. The article of footwear of claim 1, further comprising a medial side support extending from said medial member and at least partially along said sole and a lateral side support extending from said lateral member and at least partially along said sole.

* * * * *